US007766254B2

(12) United States Patent
Trapasso et al.

(10) Patent No.: US 7,766,254 B2
(45) Date of Patent: Aug. 3, 2010

(54) HEATED FUEL INJECTOR

(75) Inventors: David J. Trapasso, Bloomfield, NY (US); Arthur R. Williams, West Henrietta, NY (US); Kevin S. Hoyer, Grand Blanc, MI (US); Tanto Sugiarto, West Lafayette, IN (US); Michael A. Breed, Macedon, NY (US); Adrian G. Grammar, Geneva, NY (US); Keith E. McClain, Conesus, NY (US); Jason C. Short, Henrietta, NY (US); Orlando Volpato Filho, Piracicaba (BR); Luciano Felice, Sta Barbara d'Oeste (BR)

(73) Assignee: Delphi Technologies, Inc., Troy, MI (US)

( * ) Notice: Subject to any disclaimer, the term of this patent is extended or adjusted under 35 U.S.C. 154(b) by 15 days.

(21) Appl. No.: 12/156,233

(22) Filed: May 30, 2008

(65) Prior Publication Data

US 2009/0294552 A1 Dec. 3, 2009

(51) Int. Cl.

| | |
|---|---|
| ***B05B 1/24*** | (2006.01) |
| ***F02M 61/00*** | (2006.01) |
| ***F02M 61/16*** | (2006.01) |
| ***F02M 63/00*** | (2006.01) |
| *F02M 51/00* | (2006.01) |
| *F02M 51/06* | (2006.01) |

(52) U.S. Cl. ..... 239/135; 239/133; 239/136; 239/533.2; 239/585.1; 239/585.5

(58) Field of Classification Search ..... 239/5, 239/13, 128, 132, 133, 135, 136, 533.2, 533.3, 239/533.8, 533.9, 533.12, 585.1–585.5, 900; 123/543, 547, 549, 557

See application file for complete search history.

(56) References Cited

U.S. PATENT DOCUMENTS

| | | | | |
|---|---|---|---|---|
| 6,592,052 | B2 | 7/2003 | Hokao | |
| 7,472,839 | B2 | 1/2009 | Yasukawa et al. | |
| 2001/0052553 | A1 * | 12/2001 | Hokao | 239/135 |
| 2002/0139871 | A1 * | 10/2002 | Hokao et al. | 239/135 |
| 2007/0080239 | A1 * | 4/2007 | Yasukawa et al. | 239/135 |

* cited by examiner

*Primary Examiner*—Darren W Gorman
(74) *Attorney, Agent, or Firm*—Thomas N. Twomey

(57) ABSTRACT

A heated fuel injector includes a heated body, liquid fuel flowing through a fuel passage within the body, and a member that increases heat transfer from the heated body to the fuel within the fuel passage. The thermal efficiency of the fuel injector is increased separately or in combination by diverting the fuel flow along an inner circumferential contour of the heated body, by limiting the volume of fuel bypassing the heated inner surface of the body, by redirecting heat from the body to unheated portions of the fuel flow field within the fuel passage, and by increasing the available contact surface area for heat transfer. Improved heat transfer from the heated body to the fuel is achieved by integrating features that increase the contact surface area into the inside surface of the body or by positioning an insulating or a thermally conductive spacer within the fuel passage.

13 Claims, 14 Drawing Sheets

HEATED FUEL INJECTOR

TECHNICAL FIELD

The present invention relates to internal combustion engines; more particularly, to means for vaporizing liquid fuels; and most particularly, to an apparatus and method for effectively and evenly heating fuel within a fuel injector for consumption by the engine.

BACKGROUND OF THE INVENTION

Fuel-injected internal combustion engines fueled by liquid fuels, such as gasoline, diesel, and by alcohols, in part or in whole, such as ethanol, methanol, and the like, are well known. Internal combustion engines typically produce power by controllably combusting a compressed fuel/air mixture in a combustion cylinder. For spark-ignited engines, both fuel and air first enter the cylinder where an ignition source, such as a spark plug, ignites the fuel/air charge, typically just before the piston in the cylinder reaches top-dead-center of its compression stroke. In a spark-ignited engine fueled by gasoline, ignition of the fuel/air charge readily occurs except at extremely low temperatures because of the relatively low flash point of gasoline. (The term "flash point" of a fuel is defined herein as the lowest temperature at which the fuel can form an ignitable mixture in air). However, in a spark-ignited engine fueled by alcohols such as ethanol, or mixtures of ethanol and gasoline having a much higher flash point, ignition of the fuel/air charge may not occur at all under cooler climate conditions. For example, ethanol has a flashpoint of about 12.8° C. Thus, starting a spark-ignited engine fueled by ethanol can be difficult or impossible under cold ambient temperature conditions experienced seasonally in many parts of the world. The problem is further exacerbated by the presence of water in such mixtures, as ethanol typically distills as a 95/5% ethanol/water azeotrope.

In many geographic areas, it is highly desirable to provide some means for enhancing the cold starting capabilities of such spark-ignited engines fueled by ethanol or other blends of alcohol. There are currently several approaches to aid cold starting of such engines in cold ambients. For example, some engines are equipped with an auxiliary gasoline injection system for injecting gasoline into the fuel/air charge in cold ambient conditions. The use of such auxiliary system adds cost to the vehicle and to the operation of the vehicle and may increase the maintenance required for the engine.

Another approach to aid starting of spark-ignited engines, in cold ambient conditions, fueled by ethanol or other blends of alcohol is to pre-heat the fuel before being ignited in the combustion chamber. One such method is to provide a heat source, such as a thick film heater element, on the outside surface of a fuel injector body proximate the injector tip to pre-heat the fuel. The key to implementing this method is having sufficient heater power and heater surface area to transfer heat to the fuel. When electric current is passed through the electrically resistive material, heat is exchanged from the injector body to the fuel within the injector.

The amount of heat exchanged to the fuel within the injector is directly dependent on the heated surface area contacted by the fuel. Accordingly, it is advantageous to maximize the surface area contacted by the fuel. However, if the surface area of the heater is increased by increasing its diameter, the outside surface of the injector body needs to be increased too, which leads to an increased overall mass of the body. Notwithstanding the weight and size penalty associated therewith, if the overall mass of the body is increased, then the initial time delay to heat the fuel will also increase because the mass of the body has to be heated before its surface will heat the fuel.

Also, since a larger diameter fuel injector body causes an increased internal fluid volume, and the fuel itself is a relatively poor heat conductor, the larger volume of fluid does not transfer the heat well from the fluid near the heater surface area to the rest of the fluid. Moreover, the hollow valve assembly of prior art injectors allows fuel to pass through it, preventing the fuel passing through the valve assembly from picking up heat from the walls of the heated injector body.

Further, in prior art injectors, the heater is typically applied to the outside surface of the injector body, which is typically made of stainless steel. The heater is further typically overmolded with a plastic material in order to offer environmental protection to the electrical circuit. Stainless steel is known to be a poor heat conductor and, even when using a relatively thin injector body, most of the energy delivered by the heater is transferred to the external plastic overmold. Since the heat diffusivity of ethanol is very low, on the order of about 27 times below the one of stainless steel, this condition is worsened with the use of ethanol fuels.

What is needed in the art is a method to overcome the low heat diffusivity of ethanol and to increase the thermal efficiency of a heated fuel injector.

It is a principal object of the present invention to increase the area of the heated surface in contact with fuel flowing through the fuel injector to overcome the low heat diffusivity of ethanol fuels.

It is a further object of the invention to improve the heat transfer from the heated injector body to the fuel.

SUMMARY OF THE INVENTION

Briefly described, the thermal efficiency of a heated fuel injector is increased separately or in combination by directing the fuel flow along an inner circumferential contour of a heated injector body, by limiting the volume of fluid bypassing the heated inner surface of the injector body, by redirecting heat from the heated injector body to typically unheated portions of the fuel flow field within the fuel passage of the injector body, and by increasing the available contact surface area for heat transfer. Improved heat transfer from the heated injector body to the fuel flowing through the injector body is realized by integrating surface enlarging features into the inside surface of an injector body or by positioning an insulating spacer or a thermally conductive spacer within the fuel passage of the heated injector body. The thermally insulating spacer functions as a flow diverter and may be combined with an enlarged contact surface area and/or a plug that prevents fuel from flowing through a hollow pintle shaft. The thermally conductive internal spacer functions as a heat exchanger, has a relatively large surface area in contact with fuel flowing through the fuel injector, a relatively small mass, and maintains a tight fit with the internal surface of the heated fuel injector body for optimal heat transfer, which enables the heat to be readily transferred to the thermally conductive spacer.

In one aspect of the invention, the thermally insulating spacer is assembled within a heated body of the fuel injector surrounding a valve assembly that is free to move through a center opening of the spacer but without contacting the inner surface of the injector body. The spacer includes diversion slots to direct fuel away from the pintle valve and towards the inner surface of the heated injector body. By taking up some of the internal volume of the injector, the amount of fuel bypassing the heated surface at a time is limited and reduced compared to the fuel flow without an internal spacer and, as a result, the fuel flowing in the space between spacer and heater body is heated more evenly.

In addition to the thermally insulating spacer, a plug may be inserted in the hollow valve shaft preventing cold fuel from entering and flowing through the shaft. The combination of the flow diverter and the plug restricts cold fuel from flowing through the valve assembly enabling cold fuel, such as ethanol-fuel, to be heated more effectively within the fuel injector.

In another aspect of the invention, the area of the heated surface in contact with the fuel flowing through the injector body is increased by incorporating a variety of features, for example, a single helical channel, multiple helical channels, or an array of projecting pins, into the inside surface of the fuel injector body. The flow vortex created by these features during fuel flow increases the heat transfer to the fuel. Additionally, the increased surface area increases heat transferred from the heater to the fuel. The heated surface enlarging features may also be formed as a separate insert that is assembled into the injector body during injector manufacture. The features may be made of a heat conductive material, such as copper, aluminum, nickel, or other material compatible with the fuel used and suitable for efficient manufacturing. The enlarged internal surface area of the injector body may be used in conjunction with the non-conductive spacer as described above.

In still another aspect of the invention, the spacer may be made of a thermally conductive material and designed to contact the inner surface of the heated injector body in a thermally conductive manner to increase the thermal efficiency of the heated fuel injector. The thermally conductive internal spacer redirects heat energy from the heated injector body to otherwise unheated portions of the fuel flow field of the injector. Different materials optimized for the injector body and for the thermally conductive internal spacer can be used. In this manner, the spacer may be formed of a thermally conductive material, such as copper, while the body may be formed of stainless steel for structural purposes.

It may still further be possible to design the thermally conductive spacer to fill the space between the valve shaft and the inner surface of the heated injector body completely and to manufacture the spacer from a porous metal, such as open cell foam. The porous material permits the flow of fuel through it and increases the contact surface area for optimal heat transfer.

Furthermore, the thermally conductive spacer may be a ribbon fin heat exchanger positioned within the fuel passage of the fuel injector for transferring the heat from the heated injector body to the fuel. The ribbon fins may be formed, for example, from thin metal sheeting. This thin metal may be formed into a multitude of shapes to maximize the surface area and to optimize fuel flow. The outside of the ribbon fin may be formed into a cylinder and fixed in a thermally conductive manner, for example by brazing, to the inner surface of the injector body.

BRIEF DESCRIPTION OF THE DRAWINGS

The present invention will now be described, by way of example, with reference to the accompanying drawing, in which.

Figure 1:
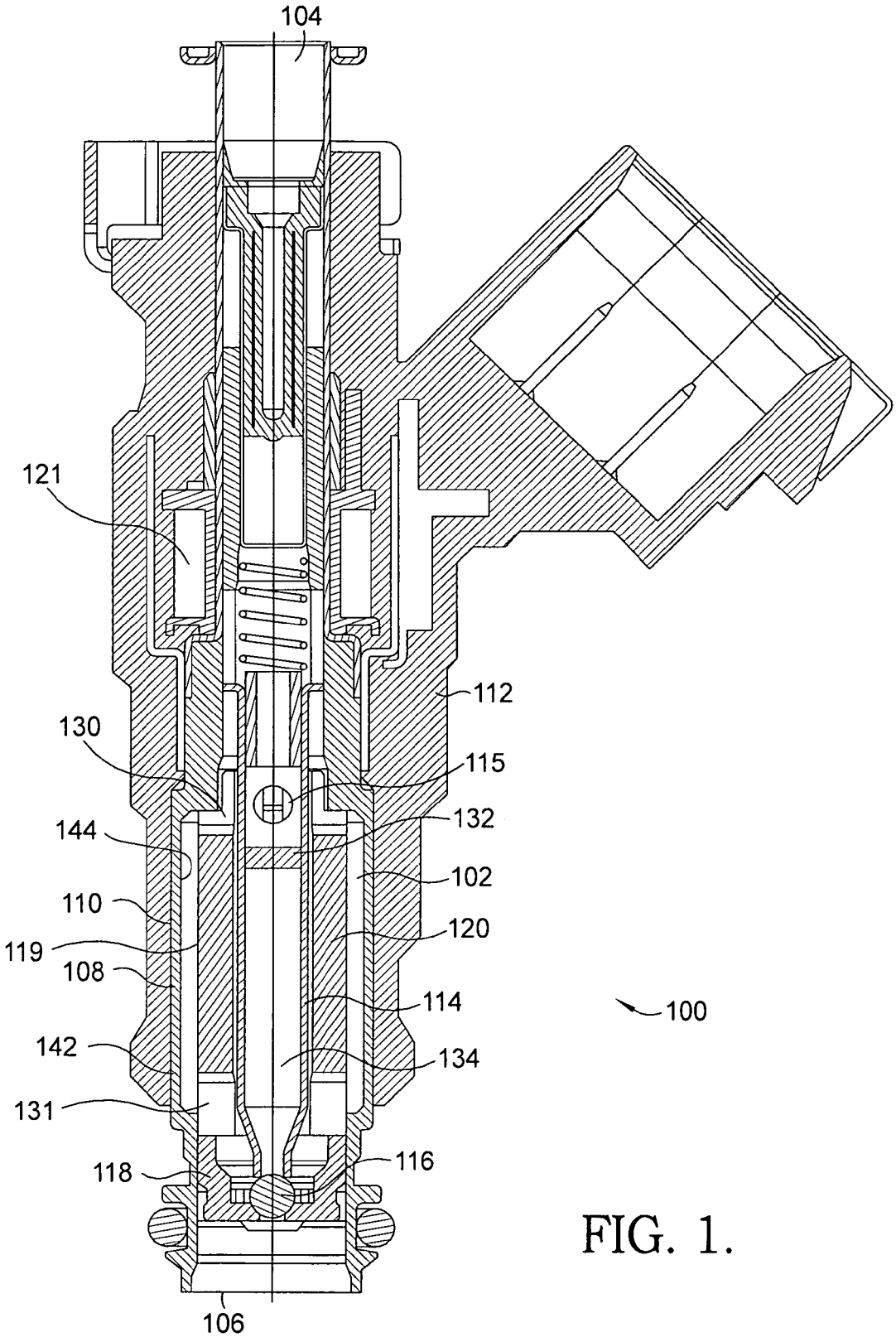
FIG. 1 is a cross-sectional view of a fuel injector with a thermally non-conductive spacer assembled, in accordance with a first embodiment of the invention.

Corresponding reference characters indicate corresponding parts throughout the several views. The exemplifications set out herein illustrate various possible embodiments of the invention, including one preferred embodiment in one form, and such exemplifications are not to be construed as limiting the scope of the invention in any manner.

DESCRIPTION OF THE PREFERRED EMBODIMENTS

Figure 2:
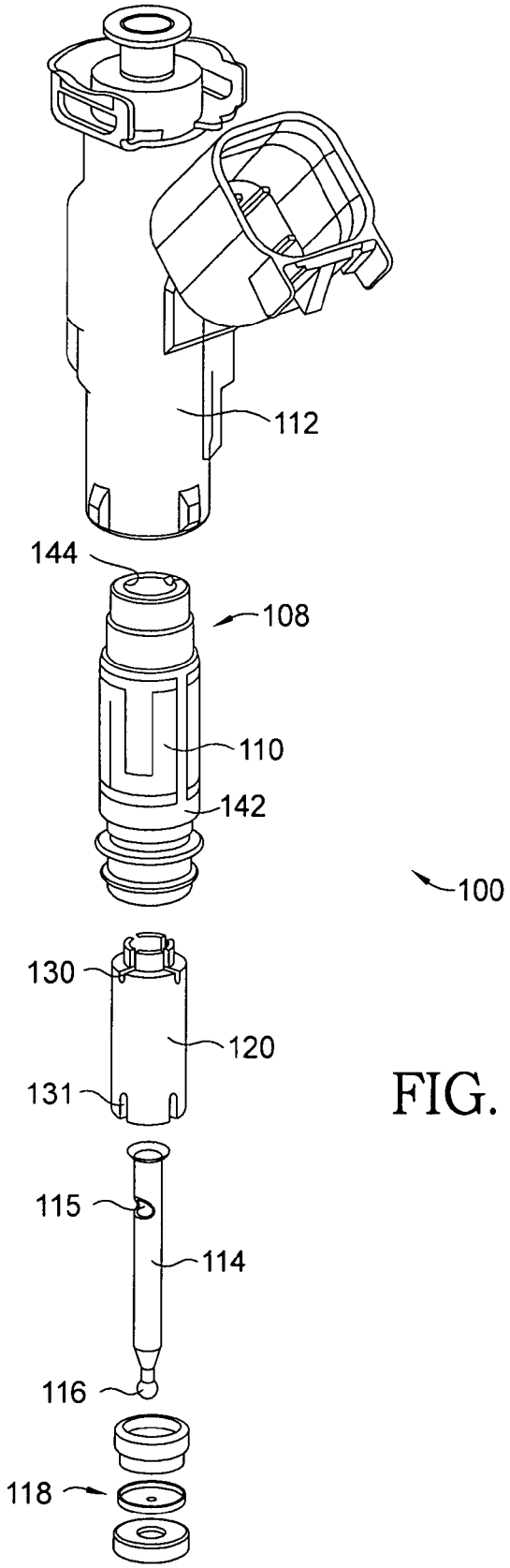
FIG. 2 is an exploded view of the fuel injector shown in FIG. 1.

Referring to FIGS. 1 and 2, a fuel injector 100 includes a spacer 120 having a low thermal conductivity, assembled within a body 108 of injector 100 in accordance with a first embodiment of the invention. Injector 100 may be a fuel injector for port injection as illustrated or a fuel injector for direct injection of fuel. The fuel flowing through fuel injector 100 from a fuel inlet 104 to a fuel outlet 106 may be any type of liquid fuel, for example, an ethanol based fuel, gasoline, or diesel.

Body 108 of fuel injector 100 has a heater element 110 applied to an outside surface 142 of the body for transferring heat to the body by the heater element. Heater element 110 may be, for example, a thick film heater printed on the outside surface 142 of body 108. An overmold 112 or other type of protection covers body 108 and heater element 110. Fuel passage 102 is defined by an inside surface 144 of body 108 and an outside surface 119 of spacer 120. A valve assembly includes pintle shaft 114 and a valve 116. Valve 116 is attached to an end of pintle shaft 114 facing fuel outlet 106 for sealing against a valve seat 118. At least a portion of pintle shaft 114 may be hollow as shown in FIGS. 1 and 2. Therefore, fuel may enter passage 102 from fuel inlet 104 through cross-hole 115 in pintle shaft 114. The valve assembly is positioned within body 108 such that a reciprocating axial movement of pintle shaft 114 is enabled by actuation of solenoid 121, as known in the art.

Figure 3B:
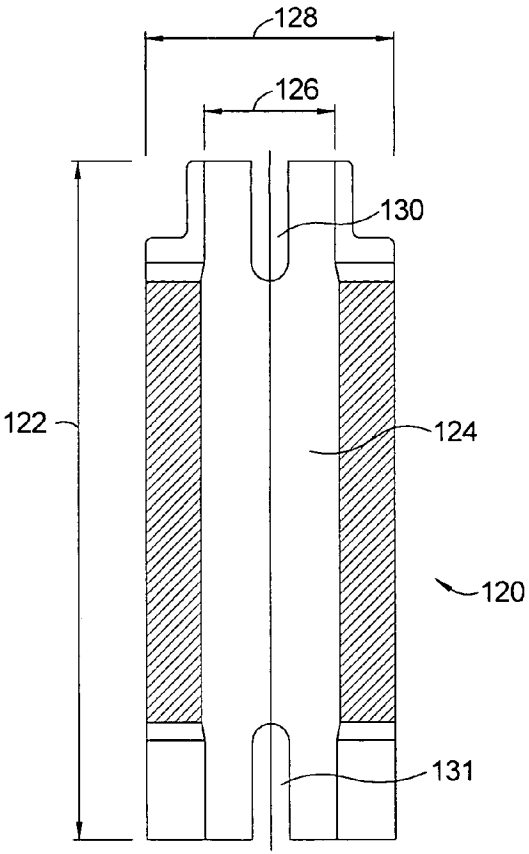
FIG. 3B is a cross-sectional view of the thermally non-conductive spacer shown in FIG. 3A.
Figure 3A:
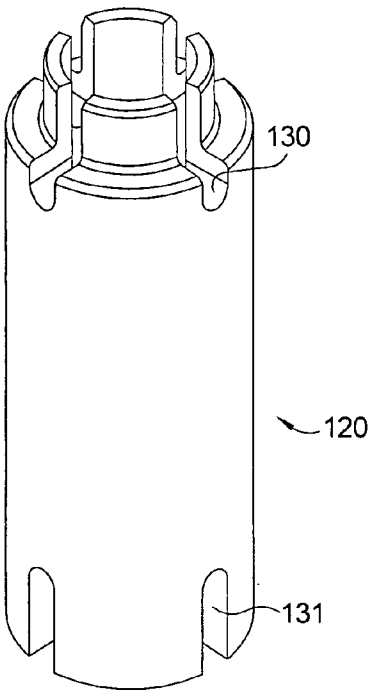
FIG. 3A is an isometric view of the thermally non-conductive spacer, in accordance with the first embodiment of the invention.

Low thermal conductivity spacer 120, shown in detail in FIGS. 3A and 3B, has a generally cylindrical shape and extends axially for a length 122. Spacer 120 includes an axially extending center hole 124 defined by an inner diameter 126. Spacer 120 further includes an outer diameter 128, at least one slot 130 at an upper end which faces fuel inlet 104, and at least one slot 131 at a lower end, which faces fuel outlet 106. Slots 130 and 131 divert fuel flow towards outer diameter 128 and heated body 108, then toward seat 118, respectively. Preferably, as shown in FIGS. 2 and 3, slots 130 and 131 are equally distributed along the circumferential contour at each end. One or more slots 130 positioned at the upper end of spacer 120 are positioned such that fuel exiting through cross-hole 115 is directed to flow into fuel passage 102 between inside surface 144 of body 108 and outer diameter 128 of spacer 120. One or more slots 131 positioned at the lower end of spacer 120 direct the heated fuel toward valve 116 and valve seat 118 and through fuel outlet 106. Spacer 120 is preferably formed from a material that has relatively low heat conductibility such as, for example, a phenolic resin, to limit heat transfer from the heated fuel to spacer 120.

A plug 132 may be disposed in pintle shaft 114 downstream of and preferably in close proximity to cross-hole 115. The combination of plug 132 and spacer 120 forces a substantial amount of the fuel to come in contact with inside surface 144 of body 108 where it is readily heated. Plug 132 prevents unheated fuel from entering a lower part of the hollow pintle shaft 114 and ensures that substantially all of the fuel flowing through injector 100 is diverted towards inside surface 144 of heated body 108. Internal space 134 of pintle shaft 114 below plug 132 is sealed by plug 132 and is typically filled with air.

Inner diameter 126 of spacer 120 is adapted to allow unrestricted reciprocating axial movement of pintle shaft 114. Inner diameter 126 is further adapted to allow minimal fuel flow through a clearance between pintle shaft 114 and spacer 120 without causing a significant drag on the moving pintle shaft. Outer diameter 128 of spacer 120 is adapted to provide a narrowed fuel passage 102 between heated body 108 and spacer 120. By doing so, the fuel volume within heated body 108 is reduced in order to heat the fuel flowing through body 108 more evenly and more effectively. Inner diameter 126 and outer diameter 128 of spacer 120 may be optimized for a specific application depending on parameters such as fuel viscosity and heating characteristics, fuel flow rate, and a desired temperature of the fuel.

In operation, fuel enters inlet 104 and flows through cross-hole 115 in pintle shaft 114 where it is directed by slots 130 to flow along fuel passage 102. The fuel makes contact with inside surface 144 of body 108, which is heated by heater element 110, and with surface 119 of spacer 120 which limits the transfer of heat from the heated fuel to pintle valve 114. Heated fuel then flows though slots 131 toward valve 116 and valve seat 118.

Referring to FIGS. 4 (A and B) through 6 (A and B), exemplary fuel injectors 200, 300 and 400, and fuel injector bodies 208, 308 and 408, including features such as single threads 246, multiple helical threads 346 and an array of projecting pins 546 are shown. These features provide an increased heated surface area coming in contact with fuel in accordance with a second embodiment of the invention. By increasing the inner surface area of the heated injector body, the efficiency of heat transfer from the heated body to a fuel having a low heat diffusivity, such as ethanol based fuels, may be increased.

Figure 4A:
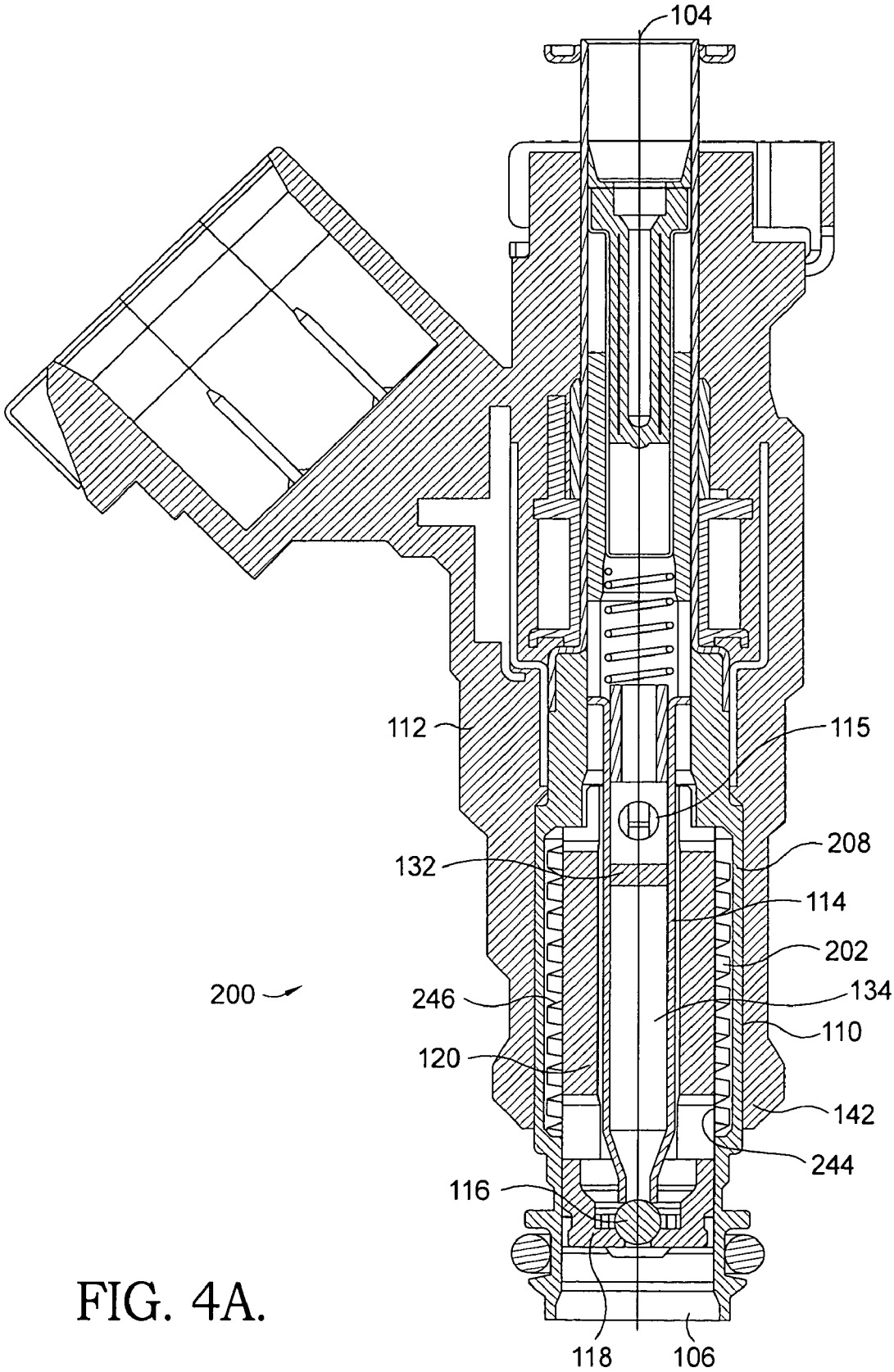
FIG. 4A is a cross-sectional view of a fuel injector including a body having a single helical channel, in accordance with a second embodiment of the invention.
Figure 4B:
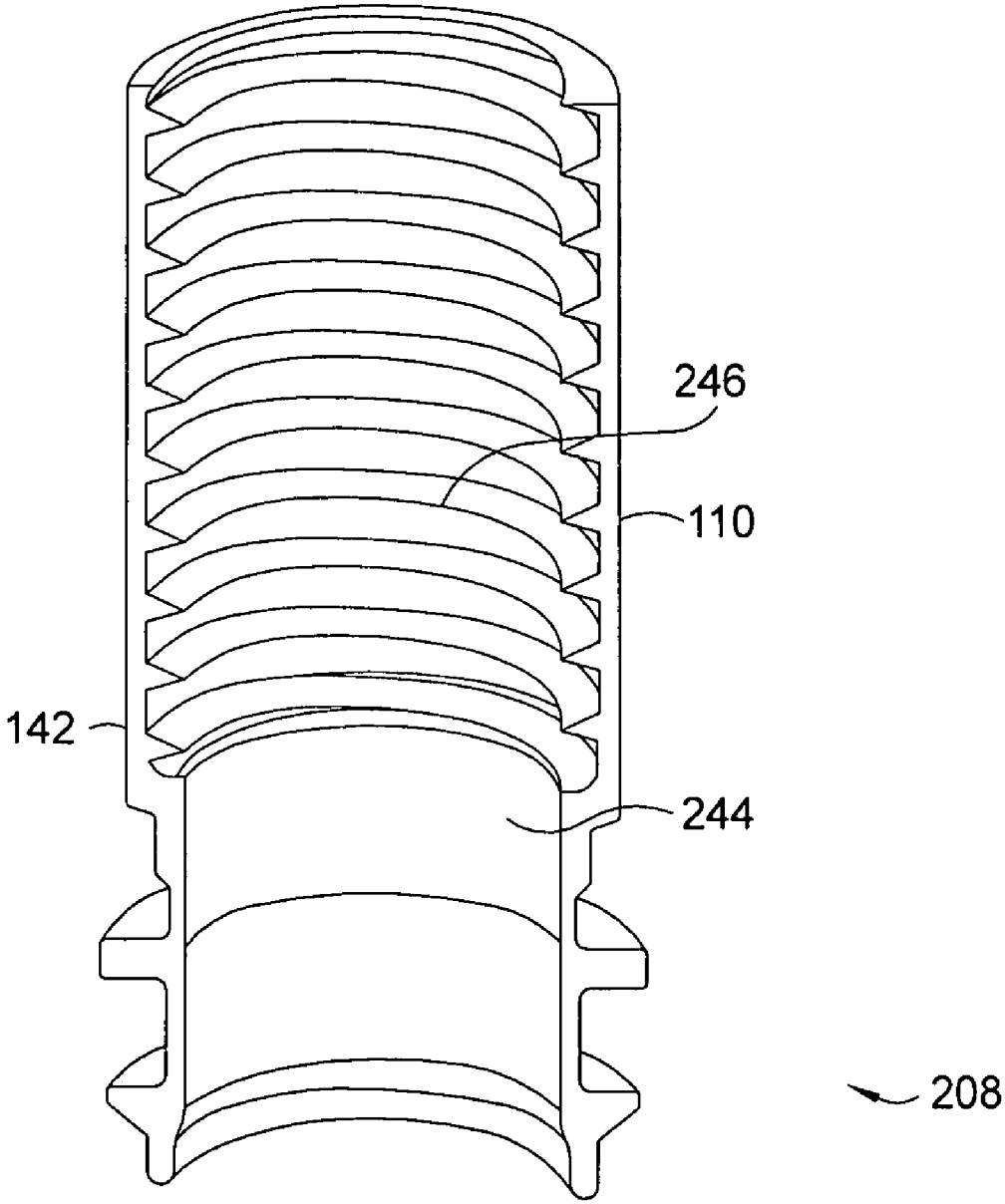
FIG. 4B is an isometric cross-sectional view of a single helical channel fuel injector body, in accordance with the second embodiment of the invention.

Referring to FIGS. 4A and 4B, a fuel injector 200 including a body 208 having an outside surface 142 and an inside surface 244 is shown. (Note: features identical with those in fuel injector 100 carry the same numbers; features analogous but not identical carry the same numbers but in the 200 series.) A single groove formed as a helical channel 246 is included on inside surface 244 of body 208. Heater element 110 is applied to outside surface 142 for transferring heat to body 208. Heat is then transferred from body 208 to the fuel flowing through helical channel 246 of fuel passage 202.

Helical channel 246 may be formed directly within inside surface 244 and, therefore, may be integral with body 208 or may be formed as a separate piece, such as an insert, that is assembled within body 208 in a thermally conductive manner. Single helical channel 246 not only increases the surface area of inside surface 244 of body 208 but also, by narrowing the flow path, creates a flow vortex which increases the amount of heat transferred to the fuel by the heated body.

In addition to increasing the surface area of inside surface 244 by single helical channel 246, spacer 120 of low thermal conductivity may be conjunctively used in body 208 to surround pintle shaft 114, to limit the transfer of heat from the fuel to the pintle shaft as described above. Plug 132 may also be inserted into pintle shaft 114 to further improve the fuel heat efficiency as described above.

Figure 5A:
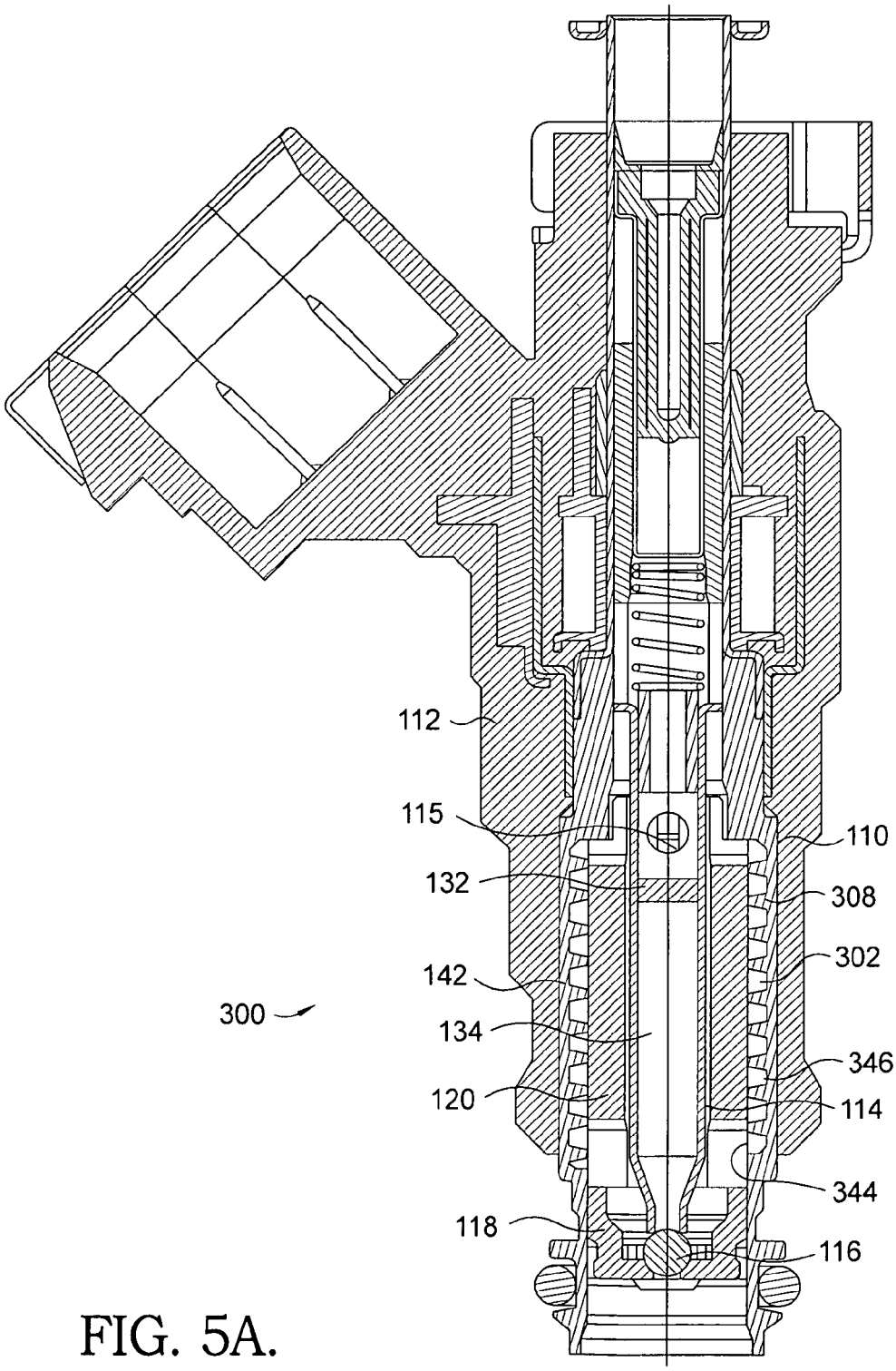
FIG. 5A is a cross-sectional view of a fuel injector including a body having multiple helical channels, in accordance with the second embodiment of the invention.
Figure 5B:
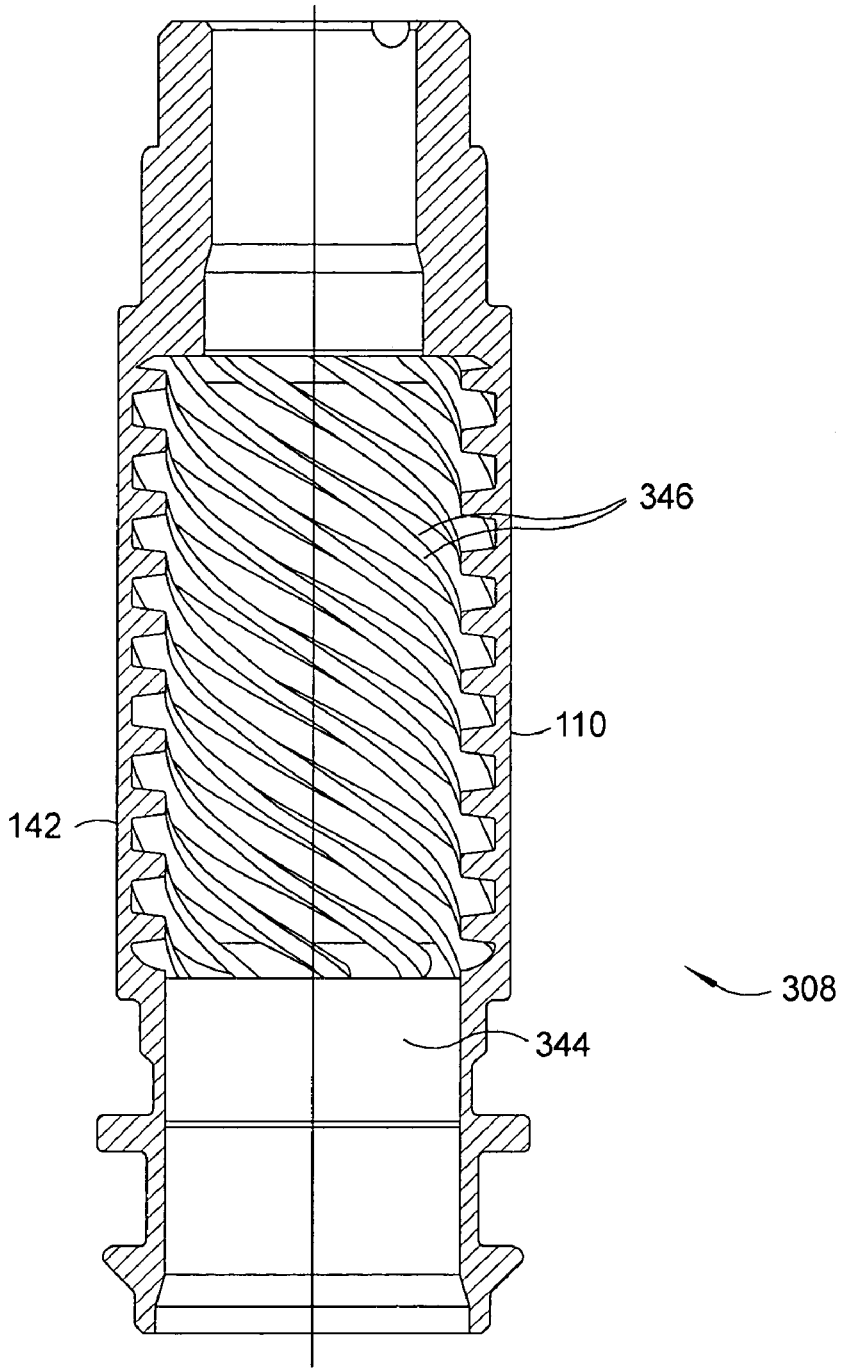
FIG. 5B is a cross-sectional view of a fuel injector body including multiple helical channels, in accordance with the second embodiment of the invention.

Referring to FIGS. 5A and 5B, a fuel injector 300 having a body 308 that has multiple helical channels 346 included at an inside surface 344 is shown. (Note: features identical with those in fuel injector 100 carry the same numbers; features analogous but not identical carry the same numbers but in the 300 series.) Multiple helical channels may be wound in the same direction as shown or may be wound in opposite directions (not shown). Multiple helical channels 346 may be formed directly on inside surface 344 and, therefore, may be integral with body 308 or may be formed as a separate piece, such as an insert, that is assembled within body 308 in a thermally conductive manner. Multiple helical channels 346 increase the surface area of inside surface 344 of body 308 and create a flow vortex which increases the amount of heat transferred to the fuel by the heated body. In addition to increasing the heated contact surface area by multiple helical channels 246, spacer 120 of low thermal conductivity may be used to limit the transfer of heat from the fuel to the pintle shaft 114 as described above. Plug 132 may also be inserted into pintle shaft 114 to further improve the fuel heat efficiency as described above.

Figure 6A:
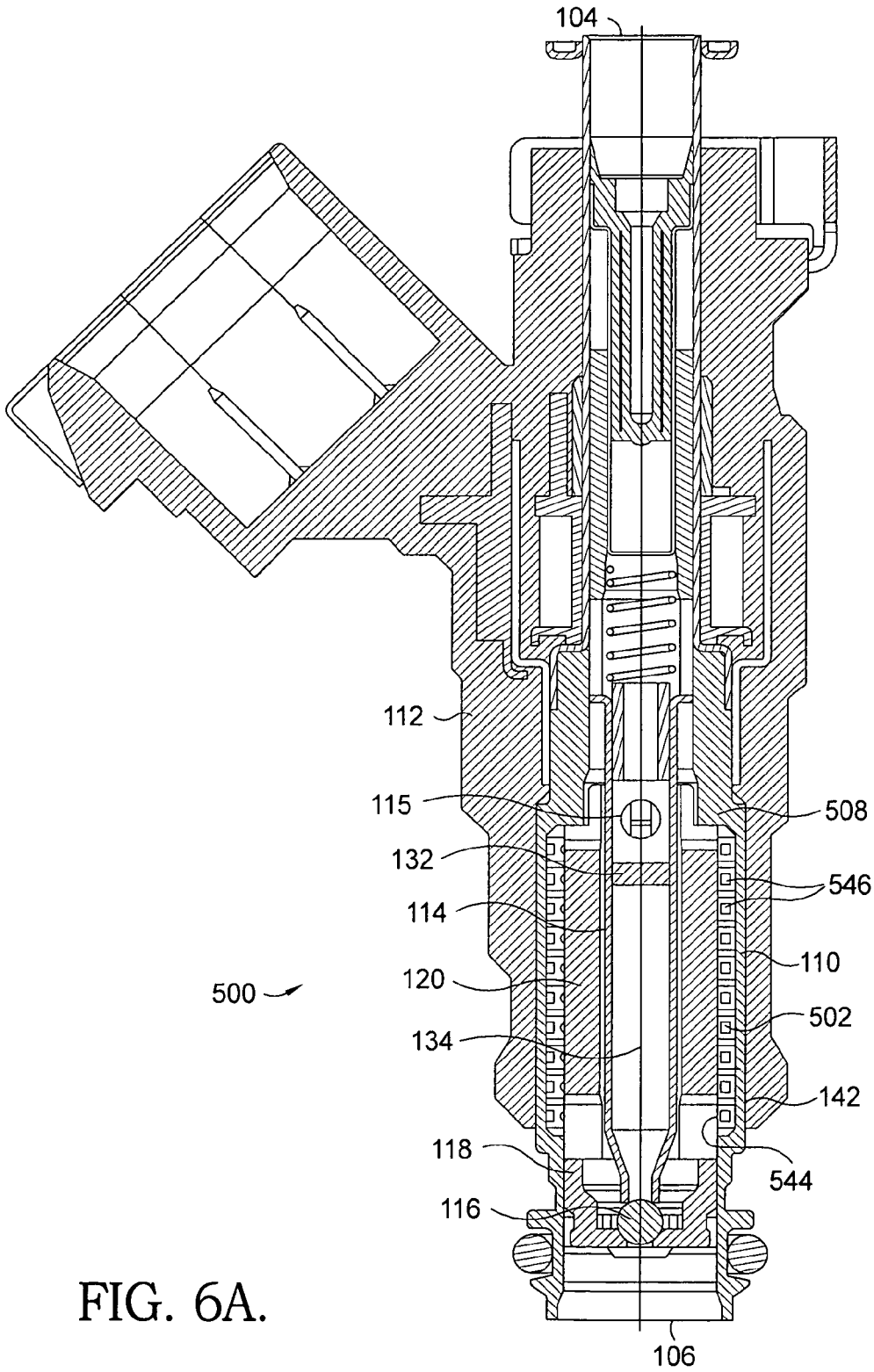
FIG. 6A is a cross-sectional view of a fuel injector including a body having an array of pins, in accordance with the second embodiment of the invention.
Figure 6B:
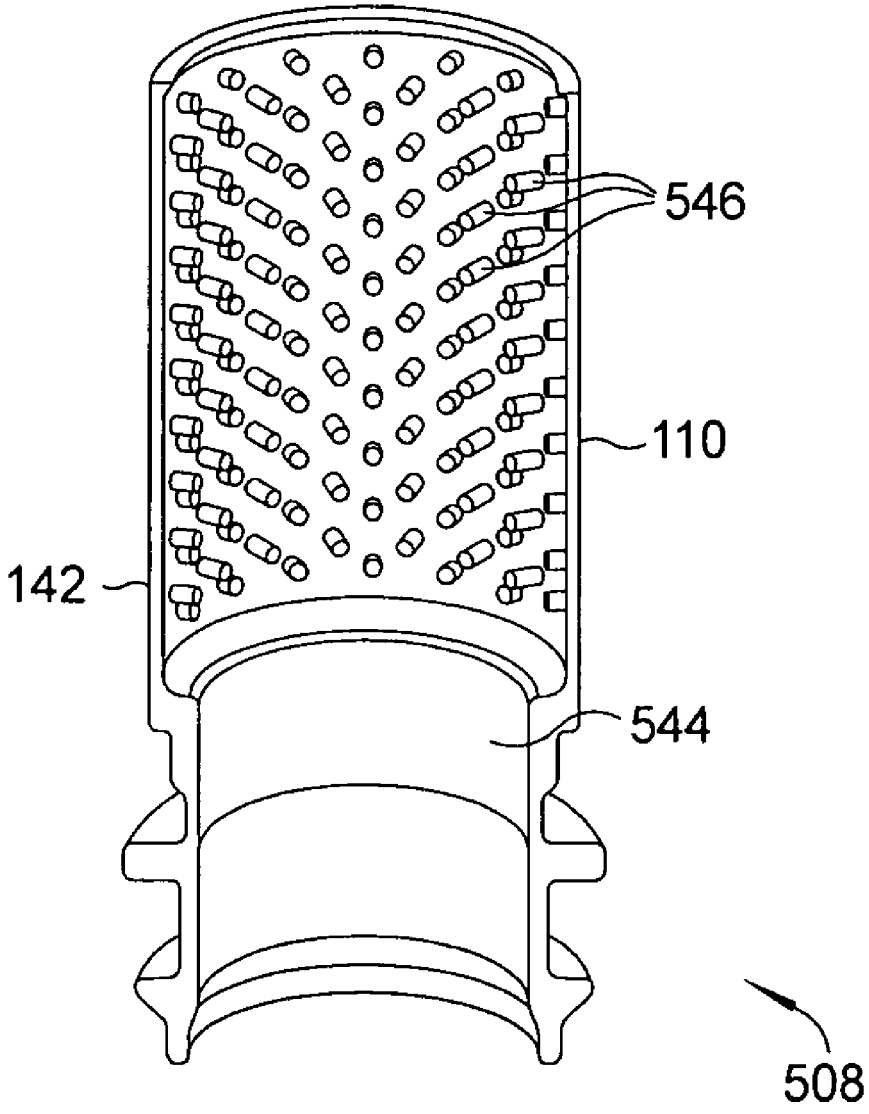
FIG. 6B is an isometric cross-sectional view of a fuel injector body including an array of pins, in accordance with the second embodiment of the invention.

Referring to FIGS. 6A and 6B, a fuel injector 500 including a body 508 having an array of projecting pins 546 on its inside surface 544 is shown. (Note: features identical with those in first embodiment fuel injector 100 carry the same numbers; features analogous but not identical carry the same numbers but in the 500 series.) Pins 546 may be of varied heights, such as shown, or of identical heights and may be dispersed in any pattern to optimize fuel flow and heat transfer. Pins 546 extend radially from inside surface 544 of body 508 into fuel passage 102 thereby increasing the surface area of inside surface 544 that comes in contact with the fuel. Pins 546 may be formed directly on inside surface 544 and, therefore, may be integral with body 508 or may be formed as a separate piece that is inserted into body 508 in a thermally conductive manner. Pins 546 not only increase the surface area of inside surface 544 of body 508 but also create a flow vortex which increases the amount of heat transferred to the fuel.

The features for increasing the heated surface area contacted by the fuel as described above, such as single helical channel 246, multiple helical channels 346, and pins 546, are preferably made of a material having a relatively good heat conductivity, such as, for example, copper, aluminum, nickel, or other materials compatible with the type of fuel used and suitable for efficient manufacturing.

Figure 7:
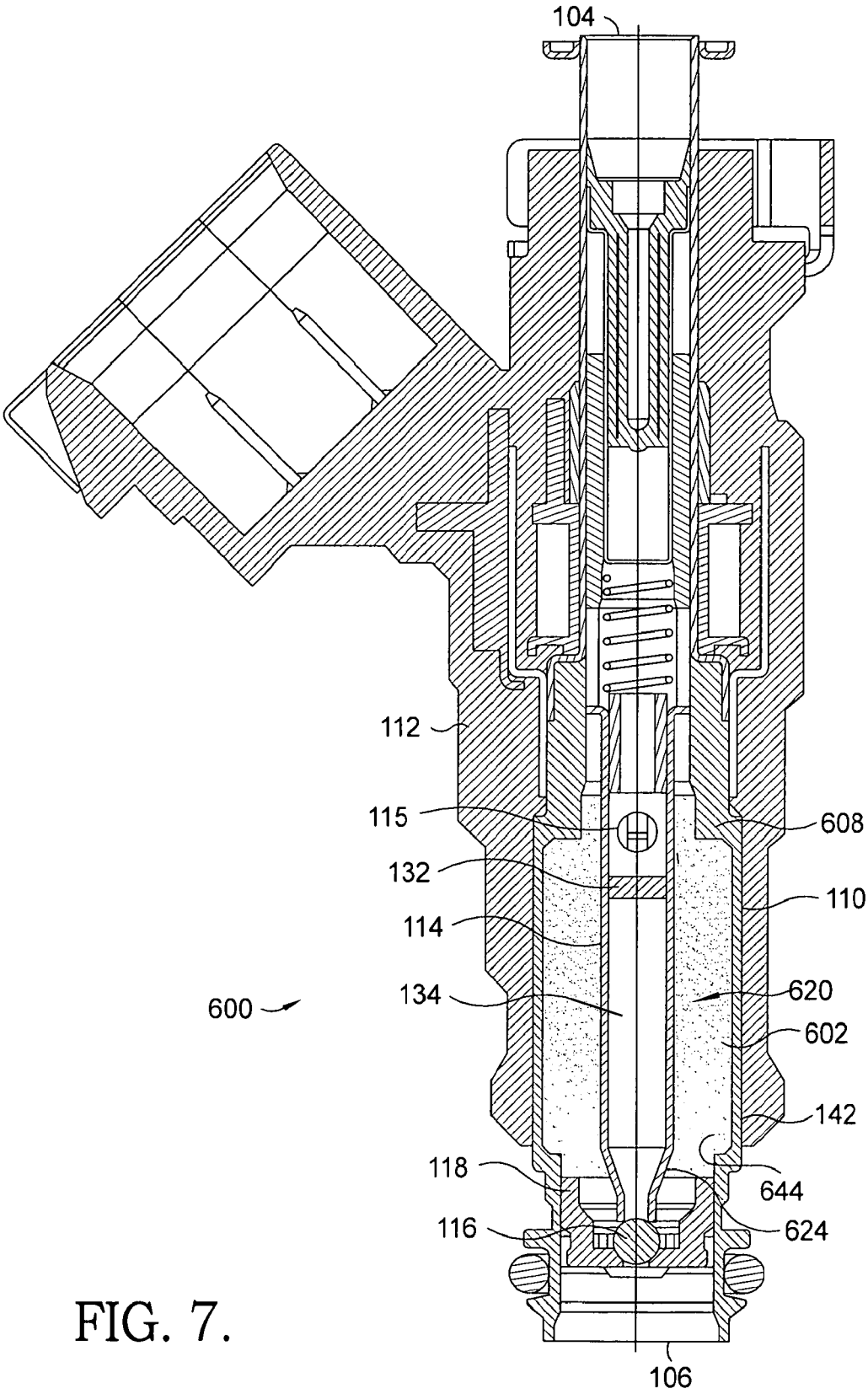
FIG. 7 is a cross-sectional view of a fuel injector including a thermally conductive porous metal spacer, in accordance with the third embodiment of the invention.
Figure 8:
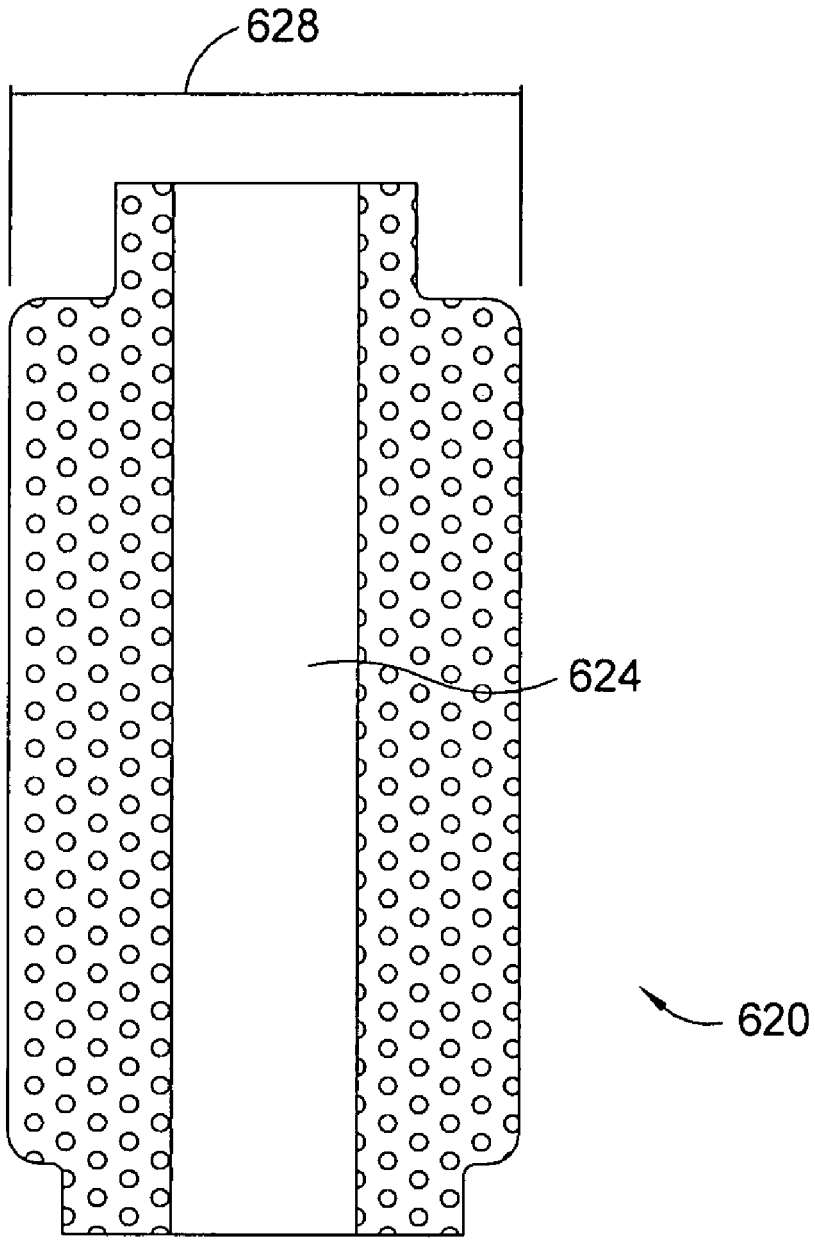
FIG. 8 is a cross-sectional view of the thermally conductive porous metal spacer shown in FIG. 7.

Referring to FIGS. 7 through 11, spacers 620, 720, and 820 are assembled within a heated body of a fuel injector, such as body 608 of fuel injector 600 as shown in FIG. 8 in accordance with a third embodiment of the invention. Thermally conductive spacers 620, 720, and 820 are in direct thermal contact with the heated body (see, for example, contact points 749 of feature 748 with body 708 in FIG. 9), and are utilized as heat exchangers conducting heat to the fuel as well. By adapting thermally conductive spacers 620, 720, and 820 to be in direct thermal contact with the heated body, the available surface area for heat transfer to the fuel can be substantially increased and heat energy can be redirected to otherwise unheated portions of the flow field of the fuel injector. As a result, the thermal efficiency of the heated fuel injector can be improved.

Spacers 620, 720, and 820 may be formed of a material different from the material of the heated body. This allows greater latitude for selecting one material best for the injector body and another material best suited for the heat transfer characteristics of the spacer. For example, the body of a fuel injector is typically made of stainless steel for its inherent corrosion resistance. By designing a spacer to be comprised of a thermally conductive material, such as copper, aluminum, or nickel, for example, superior heat transfer may be realized without compromising the structural benefits of a stainless steel body. By assembling the spacer into the body with a tight thermally conductive press fit, the undesirable welding together of dissimilar materials can be avoided.

Specifically referring to FIGS. 7 and 8, a fuel injector 600 including a thermally conductive porous metal spacer 620 assembled within a heated body 608 of fuel injector 600 in accordance with the third embodiment of the invention is shown. (Note: features identical with those in first embodiment fuel injector 100 carry the same numbers; features analogous but not identical carry the same numbers but in the 600 series.) Porous metal spacer 620 has a generally cylindrical shape and extends axially preferably over the entire length of the heated portion of heated body 608. Porous metal spacer 620 further includes a center hole 624 designed to surround pintle shaft 114 such that unrestricted reciprocating axial movement of pintle shaft 114 within spacer 620 is enabled. Center hole 624 is designed to allow minimal fuel flow through a clearance between pintle shaft 114 and spacer 620 without causing a significant drag on the moving pintle shaft 114. An outer diameter 628 of spacer 620 is adapted such that spacer 620 fills the entire fuel passage 602 between pintle shaft 114 and heated injector body 608. When inserted in body 608, the outer circumferential contour of spacer 620 contacts the inside surface 644 of body 608 in a thermally conducting matter. The porous metal spacer 630 may be formed of open cell foam such as, for example, by mixing powdered metal with a powdered organic compound, pressing the mixture in a mold, and sintering to volatize the organic material while melting some grains of metal to adjacent ones, which results in a sponge like structure.

In operation, fuel from inlet 104 enters the heated porous metal spacer 620 through cross-hole 115 of pintle shaft 114 and flows through the porous structure of spacer 620 towards valve seat 118. The porous structure of spacer 620 slows the rate of fuel flow through the spacer 620 and provides a relatively large heated contact surface area. Therefore, the amount of heat transferred to the fuel from the heated body 608 and heated spacer 620 is substantially increased. The efficiency of heat transfer may further be improved by inserting plug 132 in pintle shaft 114, as described above.

Figure 9:
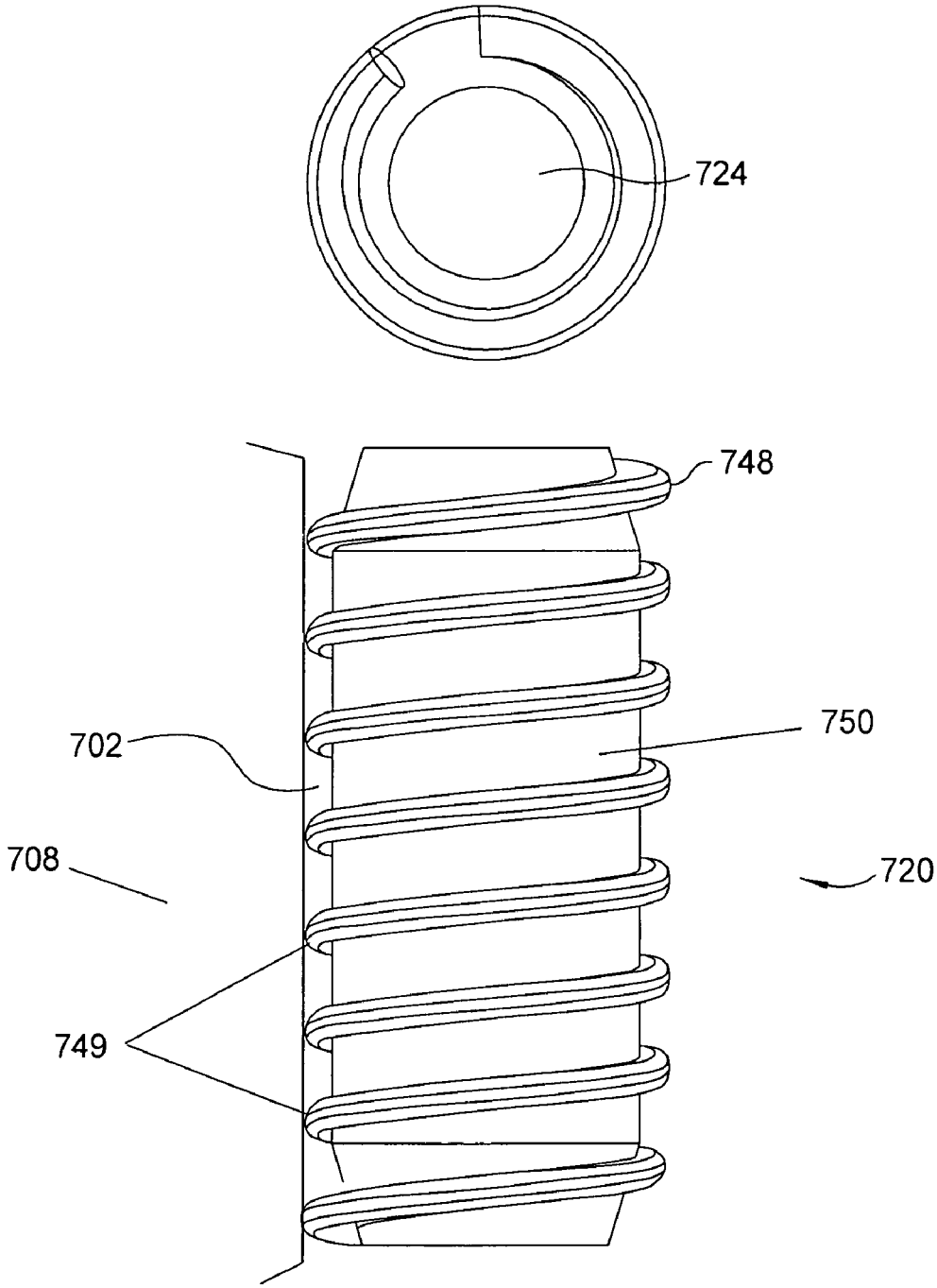
FIG. 9 is a view of another thermally conductive spacer, in accordance with a third embodiment of the invention.

Referring to FIG. 9, a thermally conductive spacer 720 for assembly within a heated body of a fuel injector is illustrated in accordance with the third embodiment of the invention. Thermally conductive spacer 720 may be assembled in heated body 608 of fuel injector 600 instead of porous metal spacer 620, as shown in FIG. 8.

Thermally conductive spacer 720 has a generally cylindrical shape including radially extending features 748 formed as a single helix and extends axially preferably over the entire length of the heated portion of a heated body 708. Spacer 720 further includes a center hole 724 designed to surround pintle shaft 114 such that unrestricted reciprocating axial movement of pintle shaft 114 within spacer 720 is enabled. Center hole 724 is designed to allow minimal fuel flow through a clearance between pintle shaft 114 and spacer 720 without causing a significant drag on the moving pintle shaft 114.

Radially extending features 748 are adapted to contact an inside surface of a heated injector body 708 at contact points 749, in a thermally conducting matter. As a result, spacer 720 is heated through heat transfer from the heated body. Features 748 extend within the fuel passage 702, thereby heating the fuel more evenly and more effectively. Radially extending features 748 may be formed as a helix wound around a core 750, as shown in FIG. 9. By forming features 748 as a helix, the dwell time that the fuel is held near the heated surfaces of the body and spacer 720 is increased.

Other configurations of features 748 are possible such as, for example, a double helix wound in the same or opposite directions.

Figure 10:
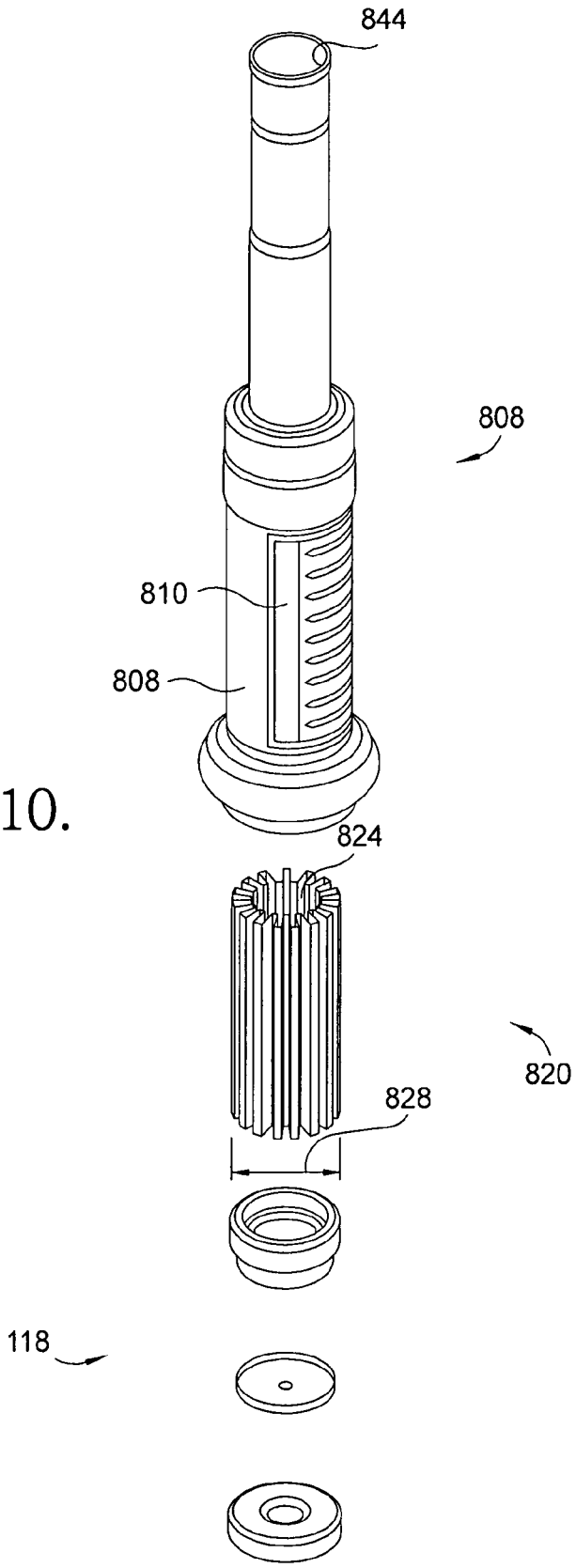
FIG. 10 is an exploded view of a heated fuel injector body-ribbon fin heat exchanger assembly, in accordance with the third embodiment of the present invention.
Figure 11:
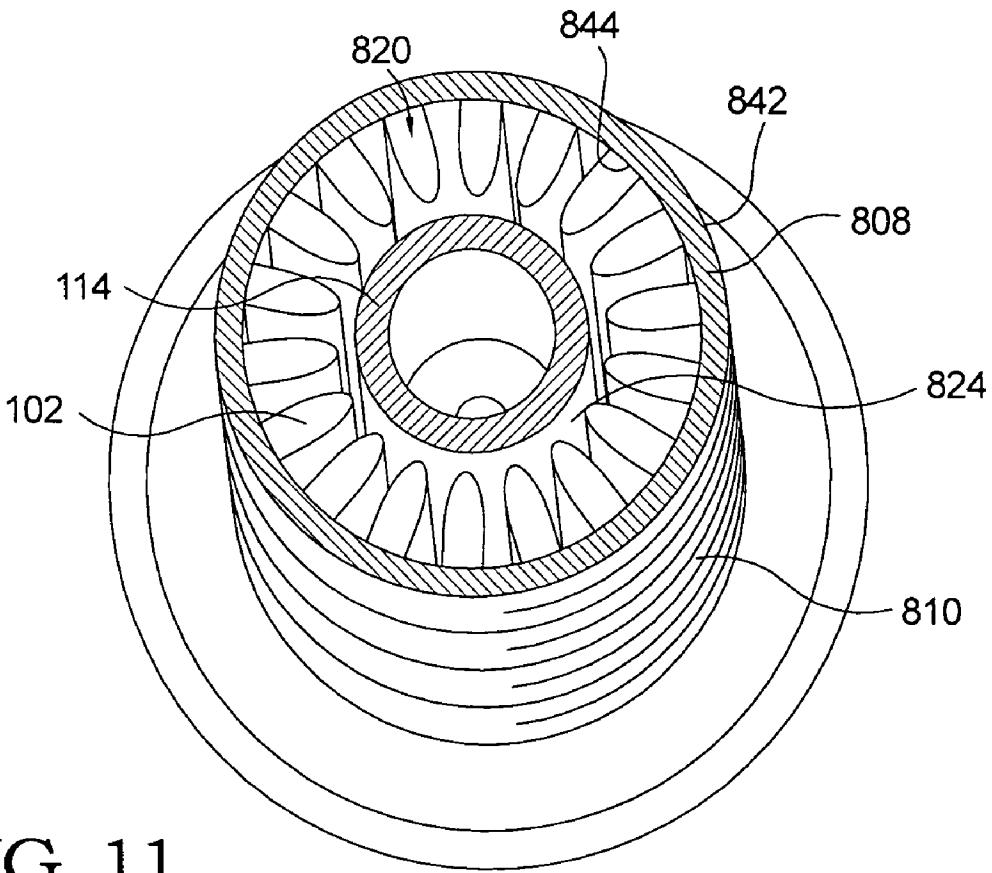
FIG. 11 is an isometric cross-sectional top view of the heated fuel injector body-ribbon fin heat exchanger assembly, in accordance with the third embodiment of the present invention.

Referring to FIGS. 10 and 11, a ribbon fin heat exchanger 820 utilized as a thermally conductive spacer for assembly within a heated body 808 in accordance with the third embodiment of the invention is shown. (Note: features identical with those in fuel injector 100 carry the same numbers; features analogous but not identical carry the same numbers but in the 800 series.) Ribbon fin heat exchanger 820 may be, for example, assembled in fuel injector 600 instead of porous metal spacer 620, as shown in FIG. 8. Body 808 may be heated by a heater element 810 applied to an outside surface 842 of body 808.

Ribbon fin heat exchanger 820 has a generally cylindrical shape and extends axially preferably over the entire length of the heated portion of heated body 808. The formed ribbon fin may be of thin metal sheeting. The metal sheeting may be formed into a multitude of shapes to maximize the surface area of ribbon fin heat exchanger 820 and is not limited to the serpentine shape illustrated in FIGS. 10 and 11. The ribbon fin is formed into a cylinder having an outer diameter 828 adapted to closely fit into the heated section of body 808. By forming the ribbon fin into a cylinder a center hole 824 is created that surrounds a pintle shaft 114, such that unrestricted reciprocating axial movement of pintle shaft 114 within heat exchanger 820 is enabled. Ribbon fin heat exchanger 820 is assembled within heated body 808 such that an outer circumferential contour of ribbon fin heat exchanger 820 is in thermally conductive contact with an inside surface 844 of body 808. Ribbon fin heat exchanger 820 may be assembled within heated body 808, for example, by press fitting or by a brazing process. By making a thermally conductive contact between ribbon fin heat exchanger 820 and heated body 808, heat is transferred from body 808 to the heat exchanger 820 increasing the available heated surface area in which fuel flowing through fuel passage makes contact. Ribbon fin heat exchanger 820 may be optimized in accordance with a specific application to provide a desired fuel flow, the largest possible surface area available for heat exchange, the smallest possible mass, and the best thermal conductivity through the entire structure. The efficiency of heat transfer of ribbon fin heat exchanger 820 may further be improved by inserting plug 132 in pintle shaft 114, as described above.

While the first, second, and third embodiment of the invention have been described as being advantageous for application in a heated fuel injector to increase the thermal efficiency of such heater fuel injector, the thermally non-conductive spacer (FIGS. 1-3), the enlarged inside surface area of the heated body (FIGS. 4-6), and the thermally conductive spacer (FIGS. 7-11) in accordance with the several embodiments of the invention may be advantageous for any application where a fluid flowing through a passage formed within the body needs to be heated from the outside of such body.

It should be understood that numerous changes may be made within the spirit and scope of the inventive concepts described, including but not limited to other configurations, materials, and locations of vaporization elements. Accordingly, it is intended that the invention not be limited to the described embodiments, but will have full scope defined by the language of the following claims.

What is claimed is:

1. A heated apparatus for heating fuel in a fuel injector, the apparatus, comprising:

a heated body having an inside surface;

a fluid passage formed radially inward from said inside surface, wherein fuel flows through said fluid passage; and a member positioned within said fluid passage and in contact with said inside surface within said fluid passage, wherein said member increases heat transfer from said heated body to said fuel and includes at least one helix extending radially from an outside surface of said member into said fluid passage.

2. The heated apparatus of claim 1, wherein said member is a spacer that narrows said fluid passage and reduces a flow volume of said fluid through said body.

3. The heated apparatus of claim 1, wherein said member is a thermally conductive spacer.

4. A fuel injector of an internal combustion engine, comprising:

a heated body having an inside surface;

a pintle shaft reciprocably movable within said heated body;

a fluid passage formed between said inside surface and said pintle shaft, wherein a liquid fuel flows through said fluid passage; and a member positioned within said fluid passage and in contact with said inside surface within said fluid passage, wherein said member increases heat transfer from said heated body to said fuel and includes at least one helix extending from an outside surface of said member into said fluid passage.

5. The heated fuel injector of claim 4, wherein said pintle shaft is hollow and includes a cross-hole that enables said fuel to flow into said fluid passage, and wherein a plug is inserted into said pintle shaft downstream of said cross-hole preventing said fuel from entering said pintle shaft below said plug.

6. The heated fuel injector of claim 4, wherein said fuel injector is a fuel injector for port injection.

7. The heated fuel injector of claim 4, wherein said body further includes an outside surface and wherein a heater element is applied to said outside surface.

8. The heated fuel injector of claim 7, wherein said heater element is a thick film heater.

9. The heated apparatus of claim 1, wherein said member contacts said inside surface downstream of an inlet to said fluid passage.

10. The heated fuel injector of claim 4, wherein said member contacts said inside surface downstream of an inlet to said fluid passage.

11. The heated fuel injector as in claim 4, wherein said member is a thermally conductive spacer.

12. A fuel injector of an internal combustion engine, comprising:

a heated body having an inside surface;

a pintle shaft reciprocably movable within said heated body;

a fluid passage formed between said inside surface and said pintle shaft, wherein fuel flows through said fluid passage; and a member positioned within said fluid passage, wherein said member increases heat transfer from said heated body to said fuel and includes at least one helix extending from a surface of said member into said fluid passage.

13. A fuel injector as in claim 12, wherein said member is a thermally conductive spacer.

* * * * *